US007352341B2

(12) United States Patent
Chae et al.

(10) Patent No.: US 7,352,341 B2
(45) Date of Patent: Apr. 1, 2008

(54) PLASMA DISPLAY PANEL DRIVING METHOD AND PLASMA DISPLAY DEVICE

(75) Inventors: Seung-Hun Chae, Suwon-si (KR); Jin-Sung Kim, Cheonan-si (KR); Woo-Joon Chung, Asan-si (KR); Kyoung-Ho Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 353 days.

(21) Appl. No.: 10/897,806

(22) Filed: Jul. 24, 2004

(65) Prior Publication Data

US 2005/0030261 A1 Feb. 10, 2005

(30) Foreign Application Priority Data

Aug. 5, 2003 (KR) ..... 10-2003-0054050

(51) Int. Cl.
*G09G 3/28* (2006.01)
*G09G 3/10* (2006.01)

(52) U.S. Cl. ..... 345/60; 315/169.4

(58) Field of Classification Search ..... 345/60, 345/210, 214, 215; 315/169
See application file for complete search history.

(56) References Cited

U.S. PATENT DOCUMENTS 5,745,086 A 4/1998 Weber
6,294,875 B1 9/2001 Kurata et al.
6,376,995 B1 * 4/2002 Kato et al. ..... 315/169.3
7,145,582 B2 * 12/2006 Shindo et al. ..... 345/691
2002/0050960 A1 * 5/2002 Setoguchi et al. ..... 345/60
2002/0167466 A1 * 11/2002 Setoguchi et al. ..... 345/60
2004/0212567 A1 * 10/2004 Kanazawa et al. ..... 345/60

FOREIGN PATENT DOCUMENTS

CN 1254153 A 5/2000
CN 1352445 A 6/2002
JP 11-119727 4/1999
JP 2000-242222 9/2000
KR 2002-0092572 12/2002

OTHER PUBLICATIONS

Patent Abstracts of Japan for publication No. 2000-242222, date of publication of Sep. 8, 2000, in the name of E. Mizobata.
Patent Abstracts of Japan for publication No. 11-119727, date of publication of Apr. 30, 1999, in the name of T. Ukai et al.
Korean Patent Abstracts for publication No. 1020020092572, date of publication of Dec. 12, 2002, in the name of J. Choi.

* cited by examiner

*Primary Examiner*—Amr A. Awad
*Assistant Examiner*—Randal L Willis
(74) *Attorney, Agent, or Firm*—Christie, Parker & Hale, LLP

(57) ABSTRACT

A PDP driving method. When a first sustain pulse is applied to a scan electrode during a sustain period, an address electrode is biased by a positive voltage, or the address electrode is biased. Therefore, when a large amount of wall charges are formed on the address and scan electrodes by address discharging during an address period, no main discharge is generated since a high potential of the address electrode is formed in the sustain period.

18 Claims, 6 Drawing Sheets

PLASMA DISPLAY PANEL DRIVING METHOD AND PLASMA DISPLAY DEVICE

CROSS REFERENCE TO RELATED APPLICATION

This application claims priority to and the benefit of Korea Patent Application No. 2003-54050 filed on Aug. 5, 2003 in the Korean Intellectual Property Office, the content of which is incorporated herein by reference.

BACKGROUND OF THE INVENTION (a) Field of the Invention

The present invention relates to a PDP (plasma display panel) driving method and a plasma display device.

(b) Description of the Related Art

A PDP is a flat display panel for showing characters or images using plasma generated by gas discharge. PDPs can include pixels numbering more than several million in a matrix format, in which the number of pixels are determined by the size of the PDP. Referring to FIGS. 1 and 2, a PDP structure will now be described.

FIG. 1 shows a partial perspective view of the PDP, and FIG. 2 schematically shows an electrode arrangement of the PDP.

As shown in FIG. 1, the PDP includes glass substrates 1, 6 facing each other with a predetermined gap therebetween. Scan electrodes 4 and sustain electrodes 5 in pairs are formed in parallel on glass substrate 1, and scan electrodes 4 and sustain electrodes are covered with dielectric layer 2 and protection film 3. A plurality of address electrodes 8 is formed on glass substrate 6, and address electrodes 8 are covered with insulator layer 7. Barrier ribs 9 are formed on insulator layer 7 between address electrodes 8, and phosphors 10 are formed on the surface of insulator layer 7 and between barrier ribs 9. Glass substrates 1, 6 are provided facing each other with discharge spaces between glass substrates 1, 6 so that scan electrodes 4 and sustain electrodes 5 can cross over address electrodes 8. Discharge space 11 between address electrode 8 and a crossing part of a pair of scan electrode 4 and sustain electrode 5 forms discharge cell 12, which is schematically indicated.

As shown in FIG. 2, the electrodes of the PDP have an n×m matrix format. The address electrodes A ($A_1$ to $A_m$) are arranged in the column direction, and n scan electrodes Y ($Y_1$ to $Y_n$) and n sustain electrodes X ($X_1$ to $X_n$) are arranged in the row direction.

U.S. Pat. No. 6,294,875 by Kurata for driving a PDP discloses a method for dividing one field into eight subfields and applying different waveforms in the reset period of the first subfield and the second to eighth subfields.

As shown in FIG. 3, a subfield includes a reset period, an address period, and a sustain period. A ramp waveform which gradually rises from voltage $V_p$ of less than a discharge firing voltage to voltage $V_r$ that is greater than the discharge firing voltage is applied to scan electrodes $Y_1$ to $Y_n$ during the reset period of the first subfield to generate weak discharges. Negative wall charges are accumulated to scan electrodes $Y_1$ to $Y_n$, and positive wall charges are accumulated to address electrodes A1 to Am and sustain electrodes $X_1$ to $X_m$ because of the discharges. The wall charges are actually formed on protection film 3 on scan electrodes 4 and sustain electrodes 5 in FIG. 1, but the wall charges are explained as being generated on scan electrodes 4 and sustain electrodes 5 below for ease of description.

A ramp voltage which gradually falls from voltage $V_q$ of less than the discharge firing voltage to a voltage of 0 volt (V) is applied to scan electrodes $Y_1$ to $Y_n$. A weak discharge is generated on scan electrodes $Y_1$ to $Y_n$ from sustain electrodes $X_1$ to $X_m$ and address electrodes $A_1$ to $A_m$ by a wall voltage formed at the discharge cells while the ramp voltage falls. Part of wall charges formed on sustain electrodes $X_1$ to $X_m$, scan electrodes $Y_1$ to $Y_n$, and address electrodes $A_1$ to $A_m$ are erased by the discharge, and they are established to be appropriate for addressing. In a like manner, the wall charges are actually formed on the surface of insulator layer 7 of address electrode 8 in FIG. 1, but they are described as being formed on address electrode 8 for ease of description.

Next, when positive voltage $V_a$ is applied to address electrodes $A_1$ to $A_m$ of the discharge cells to be selected, and voltage 0V is applied to scan electrodes $Y_1$ to $Y_n$ in the address period, address discharging is generated between address electrodes $A_1$ to $A_m$ and scan electrodes $Y_1$ to $Y_n$, and between sustain electrodes $X_1$ to $X_m$ and scan electrodes $Y_1$ to $Y_n$, by the wall voltage caused by the wall charges formed during the reset period and positive voltage $V_a$. By the address discharging, positive wall charges are accumulated on scan electrodes $Y_1$ to $Y_n$, and negative wall charges are accumulated on sustain electrodes $X_1$ to $X_m$ and address electrodes $A_1$ to $A_m$. Sustain discharging is generated on the discharge cells on which the wall charges are accumulated by the address discharging, by a sustain pulse applied during the sustain period.

A voltage level of the last sustain pulse applied to scan electrodes $Y_1$ to $Y_n$ during the sustain period of the first subfield corresponds to voltage $V_r$ of the reset period, and voltage ($V_r$–$V_s$) corresponding to a difference between voltage $V_r$ and sustain voltage $V_s$ is applied to sustain electrodes $X_1$ to $X_m$. A discharge is generated from scan electrodes $Y_1$ to $Y_n$ to address electrodes $A_1$ to $A_m$ because of the wall voltage formed by the address discharging, and a sustaining charge is generated from scan electrodes $Y_1$ to $Y_n$ to sustain electrodes $X_1$ to $X_n$ in the discharge cells selected in the address period. The discharges correspond to the discharges generated by the rising ramp voltage in the reset period of the first subfield. No discharge occurs in the discharge cells which are not selected since no address discharging is provided in the discharge cells.

In the reset period of the following second subfield, voltage $V_h$ is applied to sustain electrodes $X_1$ to $X_n$, and a ramp voltage which gradually falls from voltage $V_q$ to voltage 0V is applied to scan electrodes $Y_1$ to $Y_n$. That is, the voltage which corresponds to the falling ramp voltage applied during the reset period of the first subfield is applied to scan electrodes $Y_1$ to $Y_n$. A weak discharge is generated on the discharge cells selected in the first subfield, and no discharge is generated on the discharge cells that are not selected.

In the reset period of the last following subfield, the same waveform as that of the reset period of the second subfield is applied. An erase period is formed after the sustain period in the eighth subfield. A ramp voltage which gradually rises from 0V to voltage $V_e$ is applied to sustain electrodes $X_1$ to $X_m$ during the erase period. The wall charges formed in the discharge cells are erased by the ramp voltage.

As to the above-described conventional driving waveforms, discharges are generated on all the discharge cells by the rising ramp voltage in the reset period of the first subfield, and accordingly, the discharges problematically occur in the cells which are not to be displayed, thereby worsening the contrast ratio. Further, since the addressing is sequentially performed on all the scan electrodes in the address period of using an internal wall voltage, the internal wall voltage of the scan electrodes that are selected in the later stage is lost. The lost wall voltage reduces margins as a result.

When a severe discharge is generated during the address period, a large amount of wall charges can be generated on the address electrodes and the scan electrodes. In this instance, a main discharge may occur between the address electrodes and the scan electrodes by the voltage difference between sustain voltage $V_s$ applied to the scan electrode and the voltage 0V applied to the address electrode during the sustain period. After this, a discharge between the scan electrode and the sustain electrode is not normally generated.

SUMMARY OF THE INVENTION

The present invention provides a PDP driving method for preventing misfiring between the scan and address electrodes during a sustain period.

In one aspect of the present invention, a plasma display device includes: a PDP having discharge cells formed between a sustain electrode, a scan electrode, and an address electrode. A driving circuit applies a driving voltage to the sustain electrode, the scan electrode, and the address electrode during a reset period, an address period, and a sustain period. The driving circuit applies a second voltage to the address electrode of a discharge cell to be selected when the address electrode of discharge cells which are not selected is established to receive a first voltage, during the address period, and alternately applies a sustain pulse to the sustain electrode and the scan electrode and maintains a potential of the address electrode at a third voltage for a predetermined time, during the sustain period.

The driving circuit applies a voltage which gradually falls from a fourth voltage to a voltage for making the voltage difference between the scan electrode and the address electrode be a fifth voltage to the scan electrode during the reset period, and the difference between the voltage applied to the scan electrode of the discharge cell to be selected and the second voltage is greater than the fifth voltage in the address period.

The fifth voltage is a voltage similar to a voltage difference between the scan and sustain electrodes for the sustain discharging in the sustain period.

The fifth voltage is a voltage for firing the discharge in the discharge cell when substantially no wall charges exist in the discharge cell.

The predetermined time includes at least a time during which a first sustain pulse is applied from among the sustain pulses in the sustain period.

The predetermined time is the sustain period.

The third voltage is a voltage having the same level as that of the second voltage.

The third voltage has an amount less than the voltage of the sustain pulse applied to the scan electrode during the sustain period.

The driving circuit floats the address electrode during the predetermined time.

In another aspect of the present invention, a method for driving a PDP for forming discharge cells by first, second, and third electrodes, includes: selecting a discharge cell to be selected during an address period; and during a sustain period, alternately applying a sustain pulse to the first and second electrodes so that a main discharge may occur between the first and second electrodes, and biasing the third electrode by a first voltage for a predetermined time.

The first voltage makes the voltage difference between the first and third electrodes less than the voltage difference between the first and second electrodes when the sustain pulse is applied to the first electrode.

In still another aspect of the present invention, a method for driving a PDP for forming discharge cells by first, second, and third electrodes, includes: selecting a discharge cell to be selected during an address period; and during a sustain period, alternately applying a sustain pulse to the first and second electrodes so that a main discharge may occur between the first and second electrodes, and floating the third electrode for a predetermined time.

DETAILED DESCRIPTION

Figure 1:
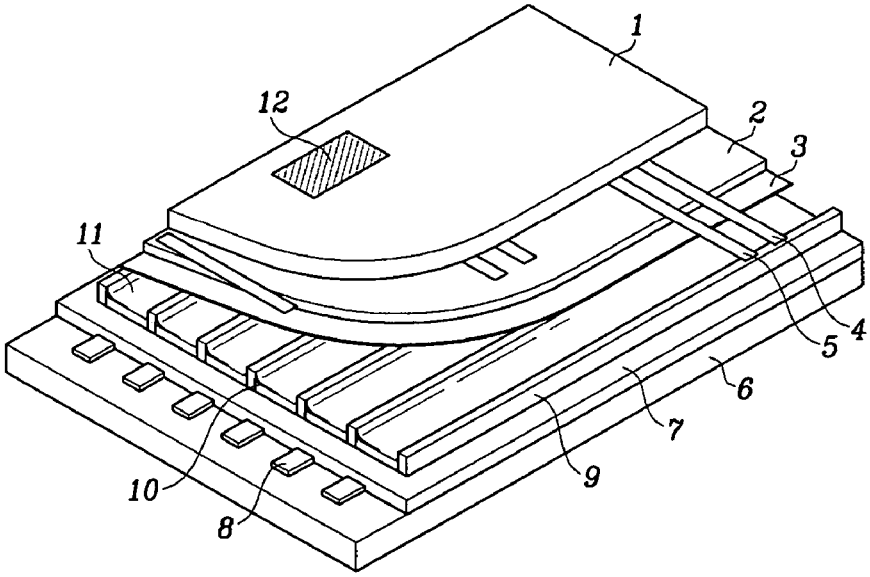
FIG.1 (Prior Art)
FIG. 1 shows a brief perspective view of a general PDP.
Figure 2:
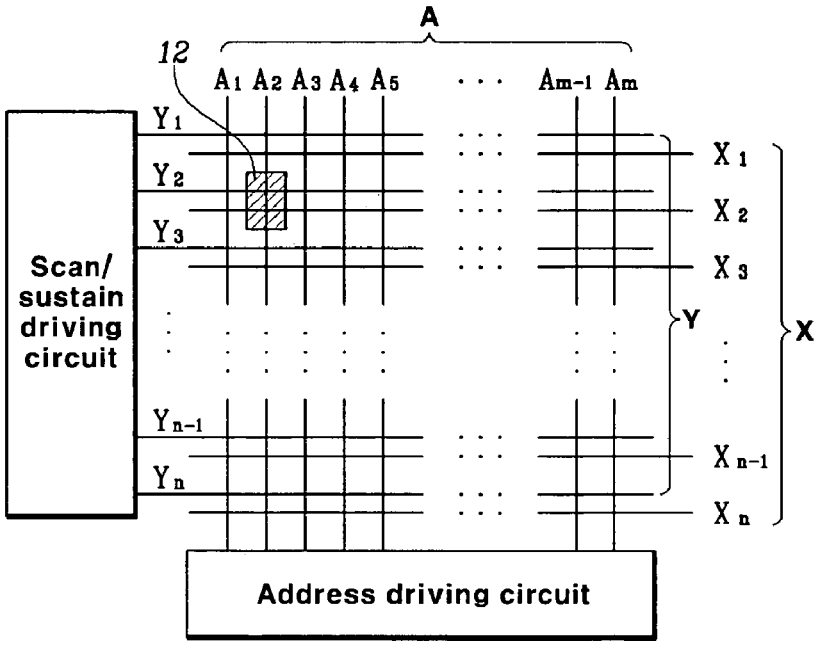
FIG.2 (Prior Art)
FIG. 2 shows an electrode arrangement diagram of a general PDP.
Figure 4:
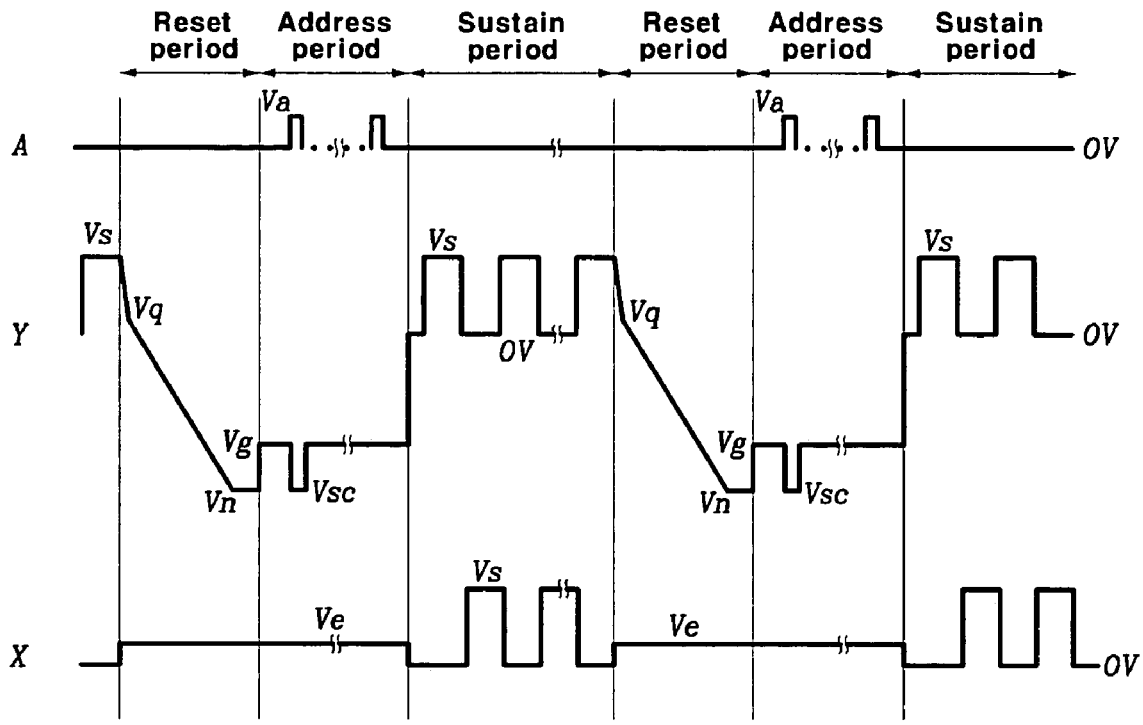
FIG. 4 shows a PDP driving waveform diagram according to a first exemplary embodiment of the present invention.
Figure 5:
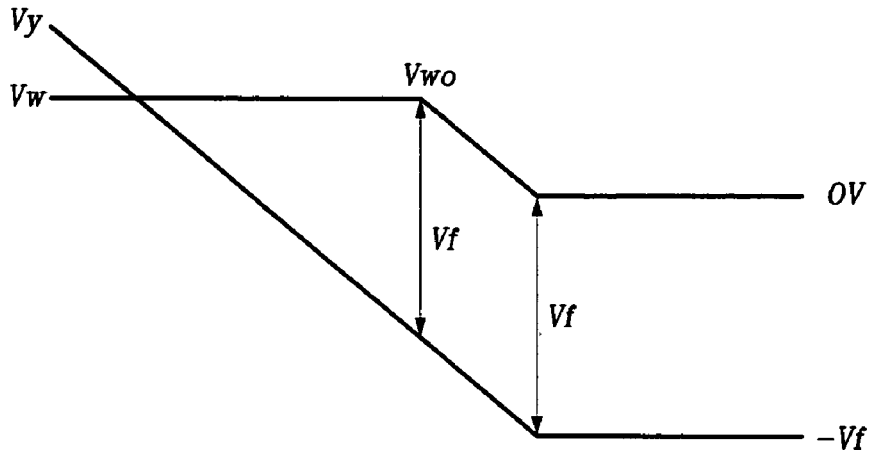
FIG. 5 shows a relational diagram between a falling ramp voltage and a wall voltage.

Referring to FIGS. 4 and 5, a PDP driving method according to a first exemplary embodiment of the present invention will be described. The PDP driving method for a discharge cell such as that described for FIGS. 1 and 2 and formed by address electrodes A, sustain electrodes X, and scan electrodes Y will be described in FIG. 4.

FIG. 4 shows a PDP driving waveform diagram according to the first exemplary embodiment of the present invention, and FIG. 5 shows a relational diagram between a falling ramp voltage and a wall voltage.

As shown, the driving waveform according to the first exemplary embodiment includes a reset period, an address period, and a sustain period. The PDP is coupled to a scan/sustain driving circuit for applying a driving voltage to scan electrodes Y and sustain electrodes X, and an address driving circuit (not illustrated) for applying a driving voltage to address electrodes A in each period. The driving circuits and the PDP coupled thereto configure a plasma display device.

The wall charges formed in the sustain period are eliminated in the reset period. Discharge cells to be displayed are selected from among the discharge cells in the address period and the discharge cells selected in the address period are discharged in the sustain period.

In the sustain period, sustain discharging is performed by a difference between the wall voltage caused by the wall charges formed in the discharge cells selected in the address period and the voltage formed by the sustain pulse applied to the scan electrode and the sustain electrode. Voltage $V_s$ is applied to scan electrodes Y at the last sustain pulse in the sustain period, and a reference voltage (shown as 0V in FIG. 4) is applied to sustain electrodes X. The selected discharge cell is discharged between scan electrode Y and sustain electrode X, and negative and positive wall charges are respectively formed on scan electrode Y and sustain electrode X.

In the reset period, a ramp voltage which gradually falls from voltage $V_q$ to voltage $V_n$ is applied to scan electrodes Y after the last sustain pulse applied in the sustain period, and the reference voltage 0V is applied to address electrodes A, and sustain electrode X is biased with voltage $V_e$. When the discharge firing voltage in the discharge cell is set to be voltage $V_f$, last voltage $V_n$ of the falling ramp voltage corresponds to voltage $-V_f$.

In general, when the voltage between the scan electrode and the address electrode or between the scan electrode and the sustain electrode is greater than the discharge firing voltage, a discharge occurs between the scan electrode and the address electrode or between the scan electrode and the sustain electrode. In particular, when the gradually falling ramp voltage is applied to generate discharges as described in the first exemplary embodiment, the wall voltage in the discharge cell is reduced by the same gradient as that of the falling ramp voltage. Since this principle is known in the art and disclosed in detail in U.S. Pat. No. 5,745,086, no further descriptions will be provided.

Referring to FIG. 5, a discharge characteristic when the ramp voltage falling to voltage $-V_f$ is applied will be described.

FIG. 5 shows a relational diagram between a falling ramp voltage and a wall voltage when the falling ramp voltage is applied to the discharge cells. Scan electrodes and address electrodes will be described in FIG. 5 assuming that predetermined wall voltage $V_o$ is formed since negative and positive charges are respectively accumulated on the scan and address electrodes before the falling ramp voltage is applied.

As shown, when the difference between wall voltage $V_w$ and voltage $V_y$ applied to the scan electrode becomes greater than discharge firing voltage $V_f$ while the voltage applied to the scan electrode is gradually reduced, a discharge is generated, and wall voltage $V_w$ in the discharge cell is reduced by the same gradient as that of falling ramp voltage $V_y$. In this instance, the difference between falling ramp voltage $V_y$ and wall voltage $V_w$ maintains discharge firing voltage $V_f$. Accordingly, wall voltage $V_w$ in the discharge cell reaches 0V when voltage $V_y$ applied to the scan electrode is reduced to voltage $-V_f$.

Since the discharge firing voltage is varied according to characteristics of the discharge cells, voltage $V_y$ applied to the scan electrode is to allow all the discharge cells to be discharged from address electrodes A to scan electrodes Y. All the discharge cells include discharge cells which are provided at an area that can influence displaying a screen on the PDP.

That is, as given in Equation 1 below, the difference $V_{A\text{-}Y,reset}$ between voltage 0V applied to address electrodes A and voltage $V_n$ applied to scan electrodes Y is established to be greater than maximum discharge firing voltage $V_{f,MAX}$ from among the discharge firing voltages. In this instance, it is desirable for the size $|V_n|$ of voltage $V_n$ to correspond to or be appropriately greater than maximum discharge firing voltage $V_{f,MAX}$ since a substantial negative wall voltage is formed when the size $|V_n|$ of voltage $V_n$ is far greater than maximum discharge firing voltage $V_{f,MAX}$.

$$V_{A\text{-}Y,reset}=|V_n|\geqq V_{f,MAX} \quad \text{Equation 1}$$

As described, the wall voltage is eliminated from all the discharge cells when a ramp voltage which falls to voltage $V_n$ is applied to scan electrodes Y. A negative wall voltage can be generated in the discharge cells having discharge firing voltage $V_f$ of less than the maximum discharge firing voltage $V_{f,MAX}$ when the size $|V_n|$ of voltage $V_n$ is set to be maximum discharge firing voltage $V_{f,MAX}$. That is, the negative wall charges are generated on address electrodes A and scan electrodes Y. The generated wall voltage in this instance is a voltage for solving non-uniformity between the discharge cells in the address period. In general, sustain voltage $V_s$ of the sustain period is set as a voltage similar to discharge firing voltage $V_{f,MAX}$ between address electrode A and scan electrode Y.

In the address period, the voltages at scan electrodes Y and sustain electrodes X are maintained at $V_g$ and $V_e$ respectively, and voltages are applied to scan electrodes Y and address electrodes A so as to select discharge cells to be displayed. That is, negative voltage $V_{sc}$ is applied to scan electrode Y of the first row, and positive voltage $V_a$ is applied to address electrode A which is concurrently provided on the discharge cell to be displayed in the first row. Voltage $V_{sc}$ corresponds to voltage $V_n$ in FIG. 4.

Accordingly, as given in Equation 2, voltage difference $V_{A\text{-}Y,address}$ between address electrode A and scan electrode Y in the discharge cell selected in the address period always becomes greater than maximum discharge firing voltage $V_{f,MAX}$, and the voltage difference between sustain electrode X to which voltage of $V_e$ is applied and scan electrode Y becomes greater than maximum discharge firing voltage $V_{f,MAX}$.

$$V_{A\text{-}Y,address}=V_{A\text{-}Y,reset}+V_a\geqq V_{f,MAX} \quad \text{Equation 2}$$

Therefore, address discharging is generated between address electrode A and scan electrode Y and between sustain electrode X and scan electrode Y in the discharge cell formed by address electrode A to which voltage $V_a$ is applied and scan electrode Y to which voltage $V_{sc}$ is applied. As a result, positive wall charges are formed on scan electrode Y and negative wall charges are formed on sustain electrode X and address electrode A.

Next, voltage $V_{sc}$ is applied to scan electrode Y in the second row, and voltage $V_a$ is applied to address electrode A provided on the discharge cell to be displayed in the second row. As a result, address discharging is generated in the discharge cell formed by address electrode A to which voltage $V_a$ is applied and scan electrode Y to which voltage $V_{sc}$ is applied, and hence, the wall charges are formed in the discharge cell. In a like manner, voltage $V_{sc}$ is sequentially applied to scan electrodes Y in the residual rows, and voltage $V_a$ is applied to the address electrodes provided on the discharge cells to be displayed, thereby forming the wall charges.

In the sustain period, voltage $V_s$ is applied to scan electrodes Y and reference voltage 0V is applied to sustain electrodes X. The voltage between scan electrode Y and sustain electrode X exceeds the discharge firing voltage in the discharge cell selected in the address period since the wall voltage caused by the positive wall charges of scan electrode Y and the negative wall charges of sustain electrode X formed in the address period is added to voltage $V_s$. Therefore, sustain discharging is generated between scan electrode Y and sustain electrode X. Negative and positive wall charges are respectively formed on scan electrode Y and sustain electrode X of the discharge cell on which the sustain discharging is generated.

Next, 0V is applied to scan electrodes Y and voltage $V_s$ is applied to sustain electrodes X. In the previous discharge cell in which the sustain discharging is generated, the voltage between sustain electrode X and scan electrode Y exceeds the discharge firing voltage since the wall voltage caused by the positive wall charges of sustain electrode X and the negative wall charges of scan electrode Y formed in the previous sustain discharging is added to voltage $V_s$. Therefore, the sustain discharging is generated between scan electrode Y and sustain electrode X, and the positive and negative wall charges are respectively formed on scan electrode Y and sustain electrode X of the discharge cell in which the sustain discharging is generated.

In the like manner, voltage Vs and 0V are alternately applied to scan electrodes Y and sustain electrodes X to maintain the sustain discharging. As described, the last sustain discharging is generated while voltage Vs is applied to scan electrodes Y and 0V is applied to sustain electrodes X. A subfield which starts from the above-noted reset period is provided after the last sustain discharging.

Figure 3:
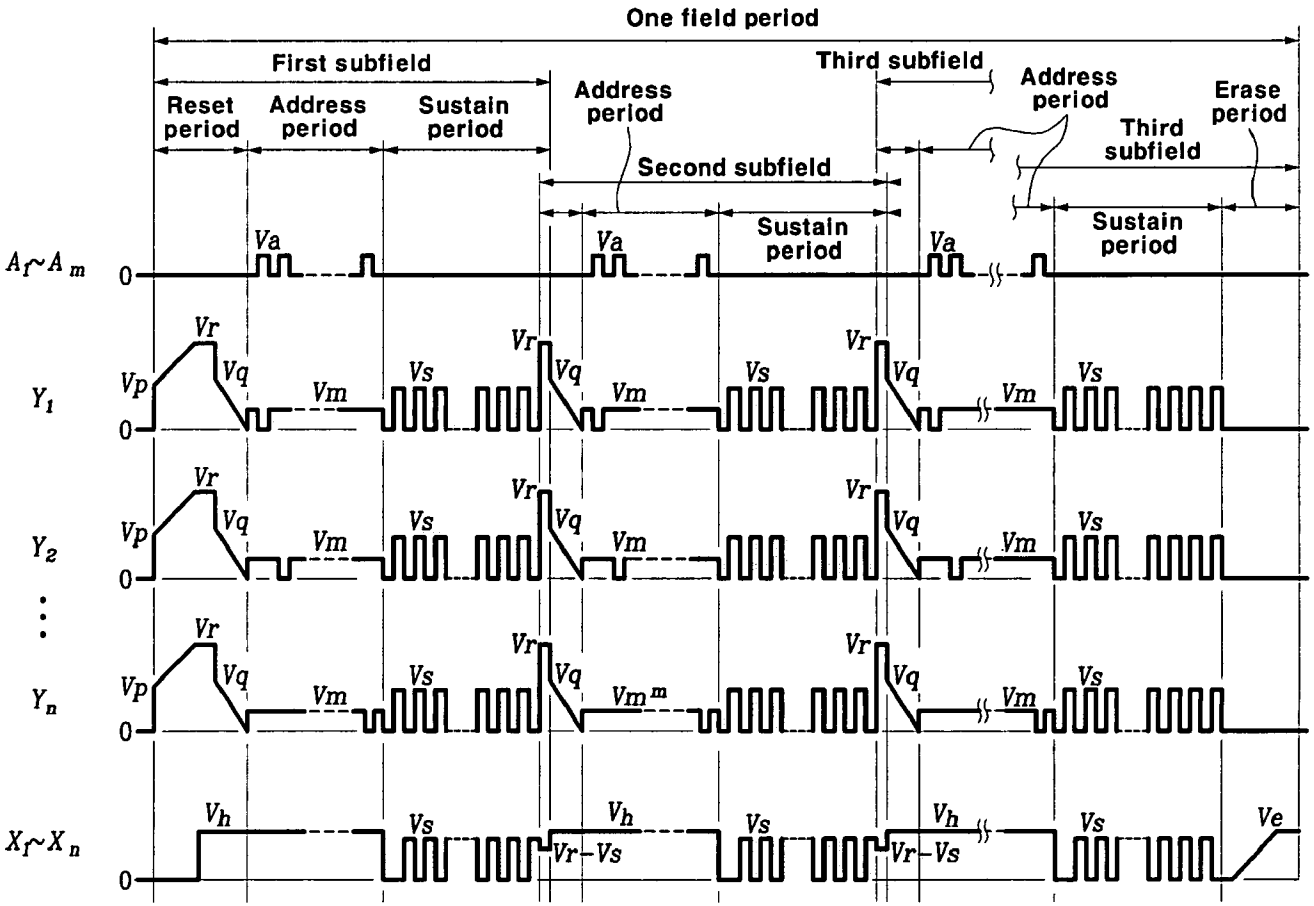
FIG.3 (Prior Art)
FIG. 3 shows a conventional PDP driving waveform diagram.

In the first exemplary embodiment, the address discharging is generated when no wall charges are formed in the reset period, by allowing the voltage difference between the address electrode and the scan electrode of the discharge cell to be displayed in the address period to be greater than the maximum discharge firing voltage. Hence, the problem of worsening the margins is removed since the address discharging is not influenced by the wall charges formed in the reset period. The amount of discharging is reduced in the reset period compared to the prior art since no wall charges are used in the address discharging, and there is no need to form the wall charges by using the rising ramp voltage in the reset period in the same manner of the prior art. Therefore, the contrast ratio is improved since the amount of discharges by the reset period is reduced in the discharge cells which do not emit light. Further, the maximum voltage applied to the PDP is lowered since voltage $V_r$ of FIG. 3 is eliminated.

The circuit for driving the scan electrodes is simplified since voltage $V_{sc}$, and voltage $V_n$ can be supplied by the same power source by making voltage $V_{sc}$ and voltage $V_n$ correspond to each other. In addition, the address discharging is generated irrespective of the wall charges since the voltage difference between address electrode A and scan electrode Y in the selected discharge cell can be greater than the maximum discharge firing voltage by voltage $V_a$.

When voltages $V_{sc}$ applied to scan electrode Y are significantly reduced in the address period, the difference between voltage $V_a$ applied to address electrodes A and voltages $V_{sc}$ becomes greater, and hence, address discharging may occur at a high voltage. When the address discharging occurs at a high voltage, a large amount of wall charges are formed on address electrodes A and scan electrodes Y, discharges are mainly generated between address electrodes A and scan electrodes Y, and the sustain discharging which must occur between scan electrode X and scan electrode Y may not be performed well.

Figure 6:
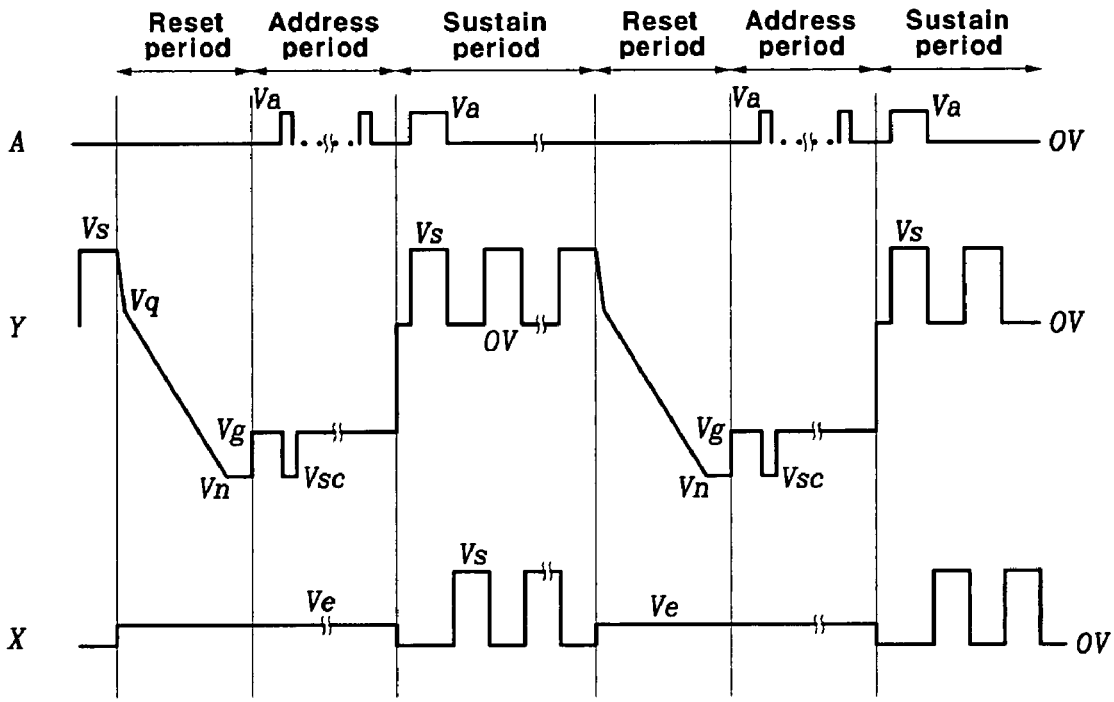
FIGS. 6 to 8 show PDP driving waveform diagrams according to second to fourth exemplary embodiments of the present invention.
Figure 7:
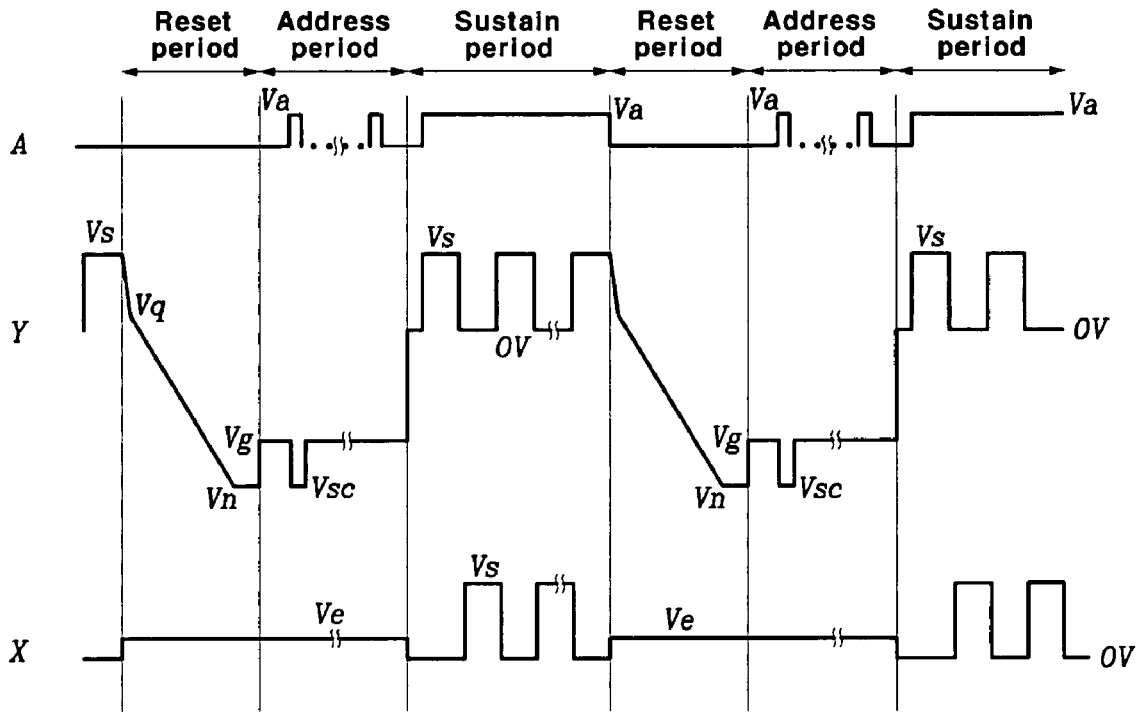
Figure 8:
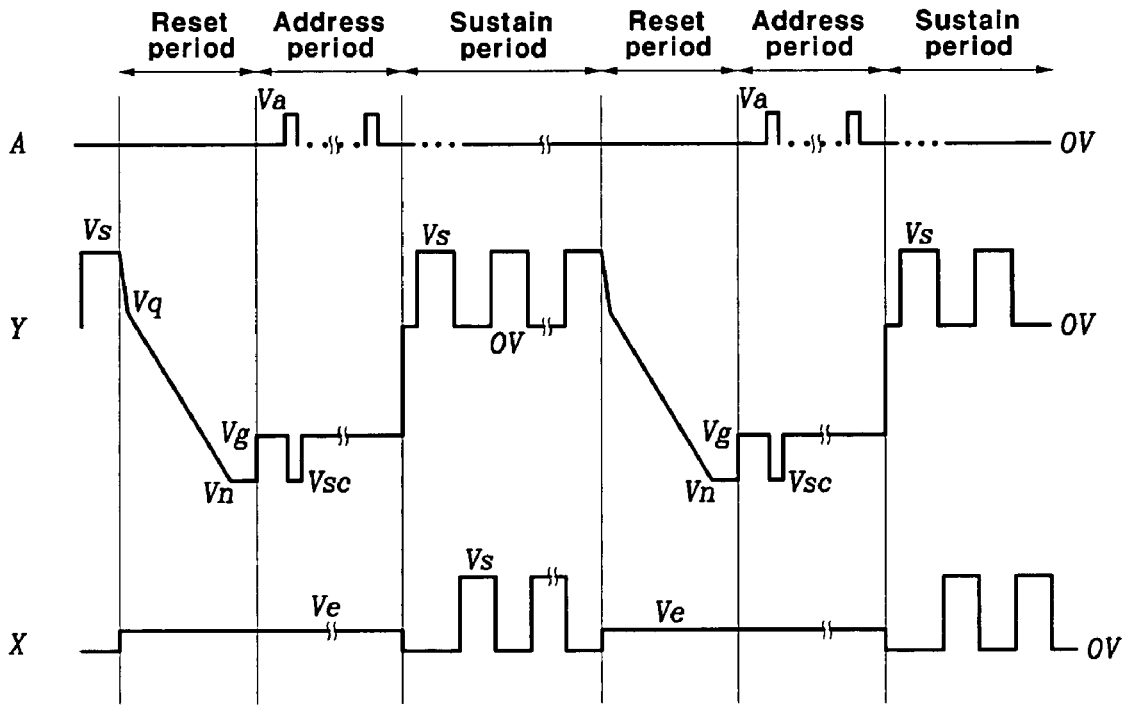

Referring to FIGS. 6 to 8, a method for controlling a discharge between address electrodes A and scan electrodes Y in the sustain period will be described.

FIGS. 6 to 8 show PDP driving waveform diagrams according to second to fourth exemplary embodiments of the present invention.

Referring to FIG. 6, a pulse having a predetermined voltage is applied to address electrode A when a first sustain pulse is applied to scan electrode Y in the sustain period in the driving waveform according to the second exemplary embodiment. The predetermined voltage corresponds to voltage $V_a$ applied to address electrode A, and accordingly, the driving circuit needs no other power source, and its driving method becomes simple. It is also possible to make the voltage difference between scan electrode Y and address electrode A be less than sustain voltage $V_s$ by using a voltage other than voltage of $V_a$.

Hence, the difference of voltages applied to scan electrode Y and address electrode A is reduced, and no main discharge is generated between scan electrode Y and address electrode A. Since the wall voltage formed on address electrode A by the sustain discharging tends to maintain a middle voltage between scan electrode Y and sustain electrode X, a large amount of the wall voltage formed on address electrode A is eliminated, and only the amount of wall charges which can maintain the middle voltage exist. Therefore, no main discharge is generated between address electrode A and scan electrode Y when a sustain pulse which swings between normal voltage Vs, 0V is alternately applied to sustain electrode X and scan electrode Y.

In addition, voltage $V_a$ applied to address electrode A can be maintained during the sustain period, or it can be maintained up to some sustain pulses and then be eliminated as described in the third exemplary embodiment of FIG. 7.

Referring to FIG. 8, address electrode A is floated while a sustain pulse is applied to scan electrode Y according to the fourth exemplary embodiment. Since address electrode A and scan electrode Y form a capacitance component, the potential of address electrode A is varied according to the voltage patterns applied to scan electrode Y. That is, the potential of floated address electrode A is increased in the same manner of voltage $V_s$ applied to scan electrode Y.

When the potential of address electrode A is increased, no main discharge is generated between address electrode A and scan electrode Y since the voltage difference between address electrode A and scan electrode Y is reduced. Address electrode A can be floated continuously or for a predetermined time during the sustain period as shown by FIG. 7 in the third exemplary embodiment. The methods described according to the second to fourth exemplary embodiments are not restricted to the driving waveform described in the first exemplary embodiment, but can be applied to other waveforms for forming a large amount of wall charges on the address electrode during the address period.

According to the present invention, the discharge between the address electrode and the scan electrode in the sustain period, which can be generated by the wall charges excessively formed during the address period, can be controlled by increasing the potential of the address electrode in the sustain period.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device comprising:

a plasma display panel having respective discharge cells between a respective sustain electrode, scan electrode, and address electrode; and a scan and sustain driving circuit for applying a driving voltage to the sustain electrode and to the scan electrode during a reset period, an address period, and a sustain period, and an address driving circuit for applying an address driving voltage to the address electrode during the reset period, the address period, and the sustain period, wherein during the reset period, the scan and sustain driving circuit gradually decreases a voltage of the scan electrode to a negative voltage, wherein during the address period, the address driving circuit applies a second voltage to the address electrode of a discharge cell to be selected when the address electrode of discharge cells which are not selected is established to receive a first voltage, wherein during the sustain period, the scan and sustain driving circuit alternately applies a sustain pulse to the sustain electrode and to the scan electrode and the address driving circuit maintains a potential of the address electrode at a third voltage for a predetermined time, wherein during the address period, the scan and sustain driving circuit applies a fourth voltage to the scan electrode of the discharge cell to be selected, wherein during the reset period, a fifth voltage is applied to the sustain electrode when the voltage of the scan electrode is at the negative voltage, wherein the difference between the second voltage and the fourth voltage is greater than a sixth voltage, and wherein the sixth voltage is a voltage substantially equal to a voltage difference between the scan electrode and the sustain electrode for sustain discharging in the sustain period.

2. The plasma display device of claim 1, wherein the sixth voltage is a voltage for firing a discharge in the discharge cell.

3. The plasma display device of claim 1, wherein the predetermined time includes at least a time during which a first sustain pulse is applied to the scan electrode in the sustain period.

4. The plasma display device of claim 1, wherein the predetermined time is the sustain period.

5. The plasma display device of claim 1, wherein the third voltage is a voltage having the same level as that of the second voltage.

6. The plasma display device of claim 1, wherein the third voltage is less than the voltage of the sustain pulse applied to the scan electrode during the sustain period.

7. The plasma display device of claim 1, wherein the address driving circuit floats the address electrode during the predetermined time.

8. A method for driving a plasma display panel having respective discharge cells between a respective first electrode, second electrode, and third electrode, comprising:

during a reset period, gradually decreasing a voltage of the first electrode from a first voltage to a second voltage when applying a third voltage to the third electrode, the second voltage being a negative voltage, and applying a seventh voltage to the second electrode when the voltage of the first electrode is the negative voltage;

during the address period, applying a fifth voltage and a sixth voltage to the first electrode and the third electrode, respectively, of a discharge cell to be selected; and during a sustain period, alternately applying a sustain pulse to the first electrode and the second electrode so that a main discharge occurs between the first electrode and the second electrode, and biasing the third electrode by a fourth voltage for a predetermined time, wherein the difference between the sixth voltage and the fifth voltage is greater than an eighth voltage, wherein the eighth voltage is a voltage substantially equal to a voltage difference between the scan electrode and the sustain electrode for the sustain discharging in the sustain period.

9. The method of claim 8, wherein the voltage difference between the first electrode and the third electrode when the fourth voltage is applied to the third electrode is less than the voltage difference between the first electrode and the second electrode when the sustain pulse is applied to the first electrode.

10. The method of claim 8, wherein the predetermined time includes at least a time during which a first sustain pulse is applied to the scan electrode in the sustain period.

11. The method of claim 8, wherein, the difference between the sixth voltage and the fifth voltage is greater than a discharge firing voltage of the discharge cell.

12. The method of claim 9, wherein the difference between the second voltage and the third voltage is greater than a discharge firing voltage.

13. The method of claim 12, wherein the discharge firing voltage is a voltage for firing the discharge in the discharge cell.

14. A method for driving a plasma display panel having respective discharge cells between a respective first electrode, second electrode and third electrode, comprising:

during a reset period, gradually decreasing a voltage of the first electrode from a first voltage to a second voltage when applying a third voltage to the third electrode, the second voltage being a negative voltage, and applying a sixth voltage to the second electrode when the voltage of the first electrode is the negative voltage;

during the address period, applying a fourth voltage and a fifth voltage to the first electrode and to the third electrode, respectively, of a discharge cell to be selected; and during a sustain period, alternately applying a sustain pulse to the first electrode and the second electrode so that a main discharge occurs between the first electrode and the second electrode, and floating the third electrode for a predetermined time, wherein the difference between the fifth voltage and the fourth voltage is greater than a seventh voltage, wherein the seventh voltage is a voltage substantially equal to a voltage difference between the scan electrode and the sustain electrode for sustain discharging in the sustain period.

15. The method of claim 14, wherein the predetermined time includes at least a time during which a first sustain pulse is applied to the scan electrode in the sustain period.

16. The method of claim 14, wherein, the difference between the fifth voltage and the fourth voltage is greater than a discharge firing voltage of the discharge cell.

17. The method of claim 16, wherein the difference between the third voltage and the second voltage is greater than the discharge firing voltage.

18. The method of claim 17, wherein the discharge firing voltage is a voltage for firing a discharge in the discharge cell.

* * * * *